US007251864B2

(12) United States Patent
Chang

(10) Patent No.: US 7,251,864 B2
(45) Date of Patent: Aug. 7, 2007

(54) TWO PIECE AND ASSEMBLEABLE SLIDER FOR APPLICATION TO RESEALABLE PORTIONS ASSOCIATED WITH A PLASTIC BAG

(76) Inventor: Chia-Hsiang Chang, 6898 Mountain Dr., Troy, MI (US) 48098

( * ) Notice: Subject to any disclaimer, the term of this patent is extended or adjusted under 35 U.S.C. 154(b) by 0 days.

(21) Appl. No.: 10/766,571

(22) Filed: Jan. 28, 2004

(65) Prior Publication Data

US 2005/0160566 A1 Jul. 28, 2005

(51) Int. Cl.
*A44B 19/26* (2006.01)

(52) U.S. Cl. ..... 24/30.5 R; 24/399; 24/415

(58) Field of Classification Search ..... 24/399, 24/400, 415, 427, 428, 430, 431, 30.5 R
See application file for complete search history.

(56) References Cited

U.S. PATENT DOCUMENTS

| | | | | |
|---|---|---|---|---|
| 3,701,191 | A | 10/1972 | Laguerre | 29/207.5 |
| 3,701,192 | A | 10/1972 | Laguerre | 29/207.5 |
| 5,010,627 | A | 4/1991 | Herrington | 24/400 |
| 5,063,644 | A | 11/1991 | Herrington | 24/400 |
| 5,070,583 | A | 12/1991 | Herrington | 24/400 |
| 5,131,121 | A | 7/1992 | Herrington | 24/436 |
| 5,283,932 | A | 2/1994 | Richardson | 24/400 |
| 5,301,394 | A | 4/1994 | Richardson | 24/399 |
| 5,448,808 | A | 9/1995 | Gross | 24/400 |
| 5,669,715 | A | 9/1997 | Dobreski | 383/5 |
| 5,867,875 | A | 2/1999 | Beck | 24/400 |
| 5,996,187 | A * | 12/1999 | Tanaka et al. | 24/399 |
| 6,247,844 | B1 | 6/2001 | Tomic | 383/64 |
| 6,477,820 | B1 | 11/2002 | Dutra | 53/412 |
| 6,526,726 | B1 | 3/2003 | Strand | 53/412 |
| 6,571,430 | B1 | 6/2003 | Savicki | 24/30.5 |
| 6,611,996 | B2 | 9/2003 | Blythe | 24/399 |
| 6,611,997 | B1 | 9/2003 | Savicki | 24/400 |
| 6,622,353 | B2 | 9/2003 | Provan | 24/585.12 |

* cited by examiner

*Primary Examiner*—William L. Miller
*Assistant Examiner*—Ruth C. Rodriguez
(74) *Attorney, Agent, or Firm*—Gifford, Krass, Groh, Sprinkle, Anderson & Citkowski, P.C.

(57) ABSTRACT

A slider for assembly over first and second extending and reclosable portions associated with a resealable bag, each of the reclosable portions includes an opposing and biasingly mating profile extending along upper edges of the bag. The slider includes a main body exhibiting a central portion and first and second hingedly attached and foldable wings. The central portion exhibits a splitter element, the foldable wings defining therebetween a resealing element. A substantially "U" shaped and assembleable cap portion is engageable upon the main body and upon the body being pre-positioned relative to the extending reclosable portions such that the splitter element separates a first location of the reclosable portions. The wings further fold downwardly against opposite sides of the bag such that the resealing elements define therebetween a narrowed passage for rejoining a second location of the reclosable portions.

8 Claims, 3 Drawing Sheets

TWO PIECE AND ASSEMBLEABLE SLIDER FOR APPLICATION TO RESEALABLE PORTIONS ASSOCIATED WITH A PLASTIC BAG

BACKGROUND OF THE INVENTION

1. Field of the Invention

The present invention relates generally to slider mechanisms for use with opposing and interengaging reclosable portions associated with a resealable plastic bag. More specifically, the present invention discloses an assembleable and two-piece slider mechanism incorporating a main body exhibiting a central splitter portion and two hingedly attached and foldable wing portions. A substantially "U" shaped and assembleable cap portion is engaged over the main body upon the same being pre-positioned relative to the extending reclosable portions.

2. Description of the Prior Art

The prior art is well documented with various examples of slider mechanisms and such as which are specifically employed with opposingly extending and reclosable portions associated with such as a resealable plastic bag. The objective in each instance is the production of a slider mechanism, capable of quickly and efficiently being secured to the reclosable portions and which is traversable to quickly unseal and reseal the bag.

U.S. Pat. No. 5,448,808, issued to Gross, teaches a foldable zipper slider with improved compression-type latching. In particular, the zipper slider includes hinged wings provided with an improved latch tongue which is deflected downward to snap in place. Additional flexible latch web structure cooperates with the latch tongue to provide additional forces which are active in assuring that the wings are fully latched and to also provide additional resistance to unlatching the wings.

U.S. Pat. No. 5,867,875, issued to Beck et al., teaches a foldable zipper slider for straddling relation with a profiled plastic zipper. The straddling slider actuates to close or open the zipper by movement therealong and includes a transverse support member including opposing sides, a pair of legs depending from the opposing sides of the support member, and a pair of wings hingedly attached to the opposing sides. Each wing has an opening for receiving its respective leg, and each further includes a cored out cross piece exhibiting a solid ramp latch. The wings are folded relative to the support member and the latches engage the legs to assemble the slider on the zipper in a closed sidewall position.

U.S. Pat. No. 5,070,583, issued to Herington, teaches a foldable plastic slider having a pair of hinged wings that fold downwardly and are secured permanently in place to the opposite sides of a slider body to attach it to the plastic reclosable fastener elements when manufacturing a thermoplastic bag. The wings are hinged at the top of the slider body to provide for ease in molding the slider using a simple two-piece mold. Additional examples of foldable zipper assemblies are also illustrated in Herrington U.S. Pat. No.5,063,644 and Herrington U.S. Pat. No. 5,131,121.

U.S. Pat. No. 5,283,932, issued to Richardson, teaches a flexible plastic slider having sidewalls normally diverging outwardly and spaced apart a distance adequate for transverse installation of the slider over the profiled elements of a zipper with rigidizing structure on the slider to move the sidewalls into and retain them in an assembled position on the zipper to prevent the slider from being lifted off the zipper.

Finally, U.S. Pat. No. 6,247,844, issued to Tomic et al., teaches a resealable slider closure mechanism including a first closure profile, a second closure profile, a slider and a plow. The plow is a separate piece that is attached to an underside location of the slider. The slider and plow are designed to receive the first and second closure profiles, and in particular such that they slide along the first and second closure profiles in a first direction to cause the profiles to engage, and as opposed to sliding in a second direction to cause the profiles to disengage. The plow further exhibits first and second closure profiles including first and second side walls that are tapered at one end to cause the first and second closure profiles to engage.

SUMMARY OF THE PRESENT INVENTION

The present invention is an assembleable and two-piece slider mechanism for selectively opening and resealing opposing and mating profiles associated with first and second reclosable portions of a plastic bag. The slider mechanism includes a main body exhibiting a central portion from which extends a splitter blade, and two hingedly attached and foldable wing portions engaging against sides of the bag and further defining, at an end opposite the splitter blade, a narrowed aperture for resealing the mating male and female profiles.

A substantially "U" shaped and assembleable cap portion is engaged over the main body upon the same being pre-positioned with the blade between the reclosable portions and the wings folded in opposing and engaging contact against the sides of the bag and with the narrowed aperture defining a resealing location of the male and female profiles. The exterior surfaces of the foldable wings and interior surfaces of the assembleable cap further define mating surface configurations for securely attaching the cap and the main slider body to the resealable bag.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring to FIGS. 1–7, an assembleable slider is illustrated at 10 according to a preferred embodiment of the present invention. As previously discussed, the present invention provides a novel and improved two-piece slider, as generally shown at 10, for assembly over and between a pair of opposingly extending and reclosable portions. The reclosable portions are illustrated at 12 and 14 throughout the several views and form a portion of a plastic bag 16 (see as further shown in FIGS. 1 and 2).

Figure 4:
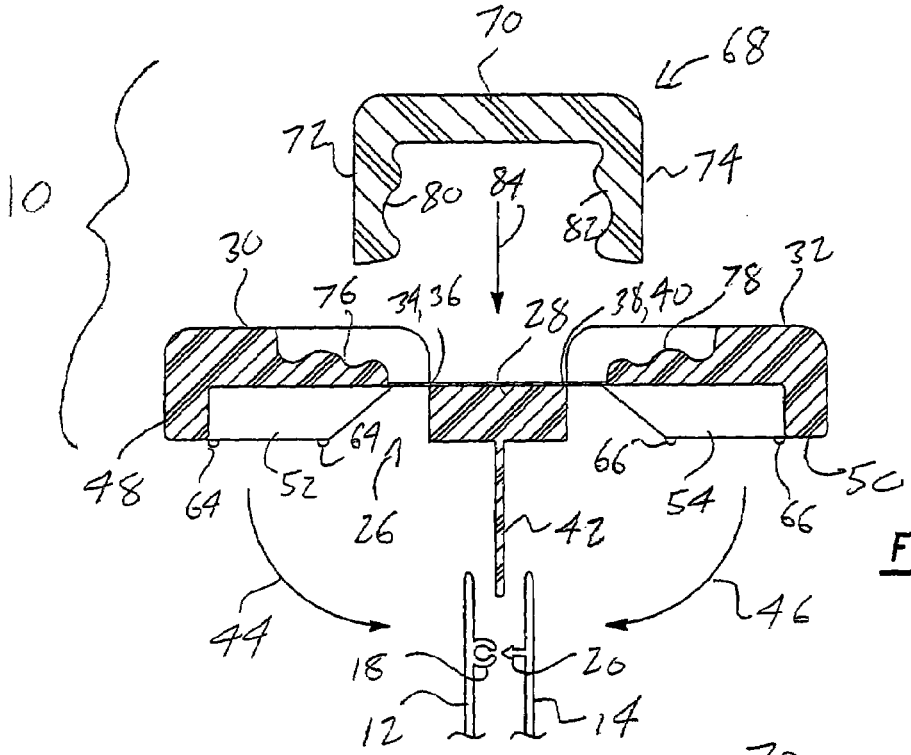
FIG. 4 is a cutaway illustration of the main body, taken along line 4—4 of FIG. 3, and further showing the pre-positioned orientation of the opposing and reclosable portions as well as the assembleable cap.
Figure 5:
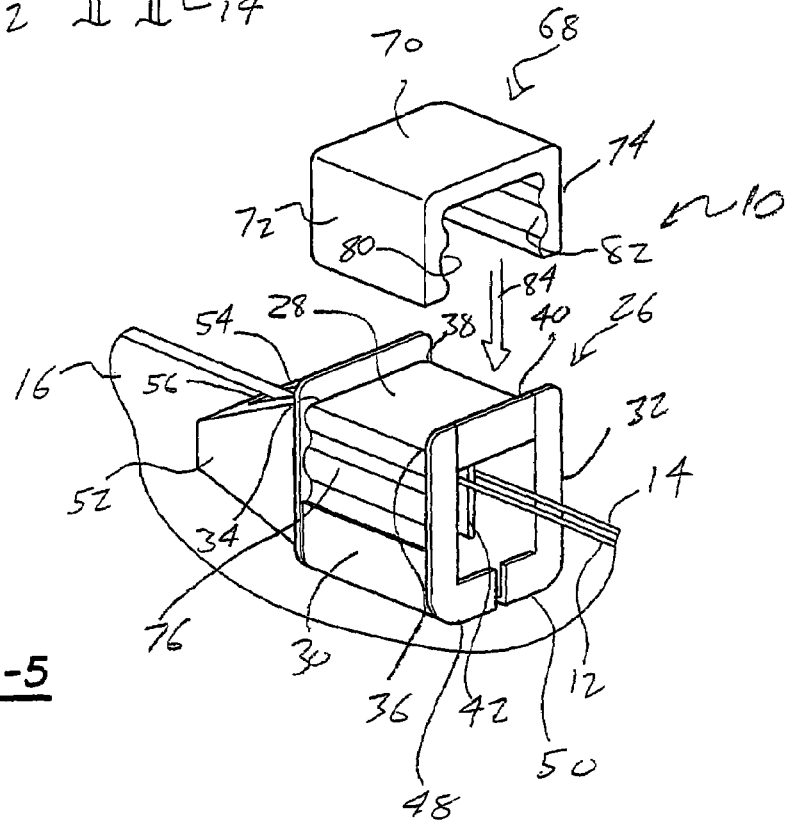
FIG. 5 is a perspective view of an intermediate assembly step by which the cap is illustrated in arrayed and downwardly engageable fashion above the main body in pre-positioned fashion relative to the reclosable portions.
Figure 6:
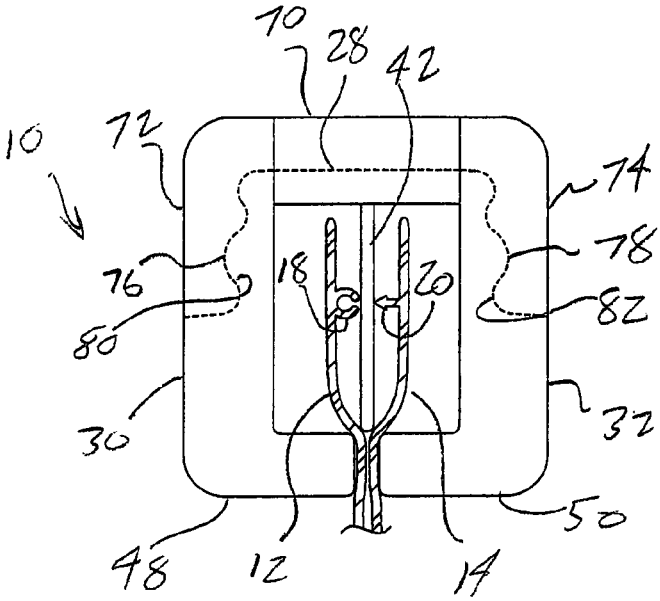
FIG. 6 is an end view of the assembled slider and in particular illustrating the separating action of the blade associated with the central body.
Figure 7:
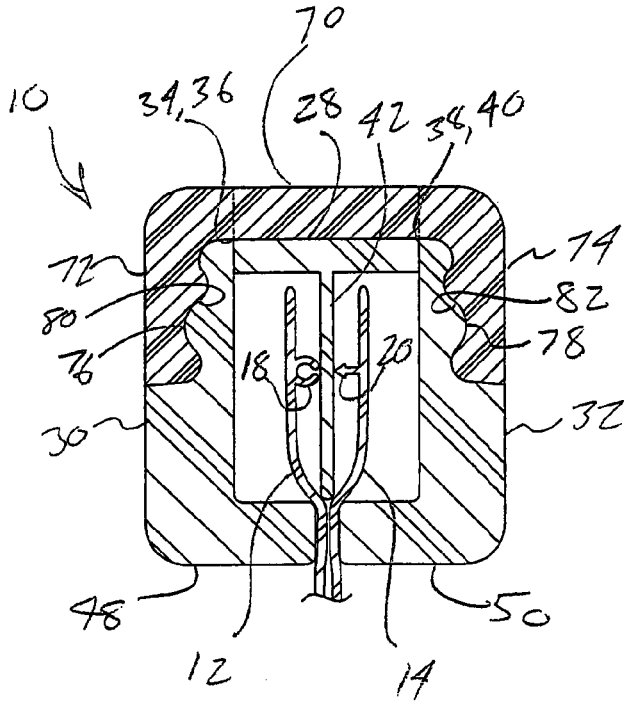
FIG. 7 is a cutaway illustration taken along line 7—7 of FIG. 2, similar in regards to that shown in FIG. 6, and illustrating a substantially central cross sectional arrangement of the assembled slider relative to the opposing and reclosable bag portions.

Each reclosable portion includes an inwardly facing and opposing biasingly engaging profile, see as best shown by female profile 18 for reclosable portion 12 and by male profile 20 for reclosable portion 14 in FIGS. 4, 6 and 7. As is further illustrated in FIG. 1, upper ends of the bag 16 are heat staked or otherwise sealed, see as shown by portions 22 and 24, and define therebetween the extending and reclosable portions 12 and 14.

The slider assembly 10 includes a main body, generally illustrated at 26, having a central substantially rectangular shaped portion 28 and first 30 and second 32 extending and foldable wings. The main body 26 is further constructed of a durable plastic material and further such that the wings 30 and 32 are hingedly secured, such as are referenced in FIG. 3 at locations 34 & 36 for wing 30 and at locations 38 & 40 for wing 32, to opposite edges of the central portion 28.

Figure 1:
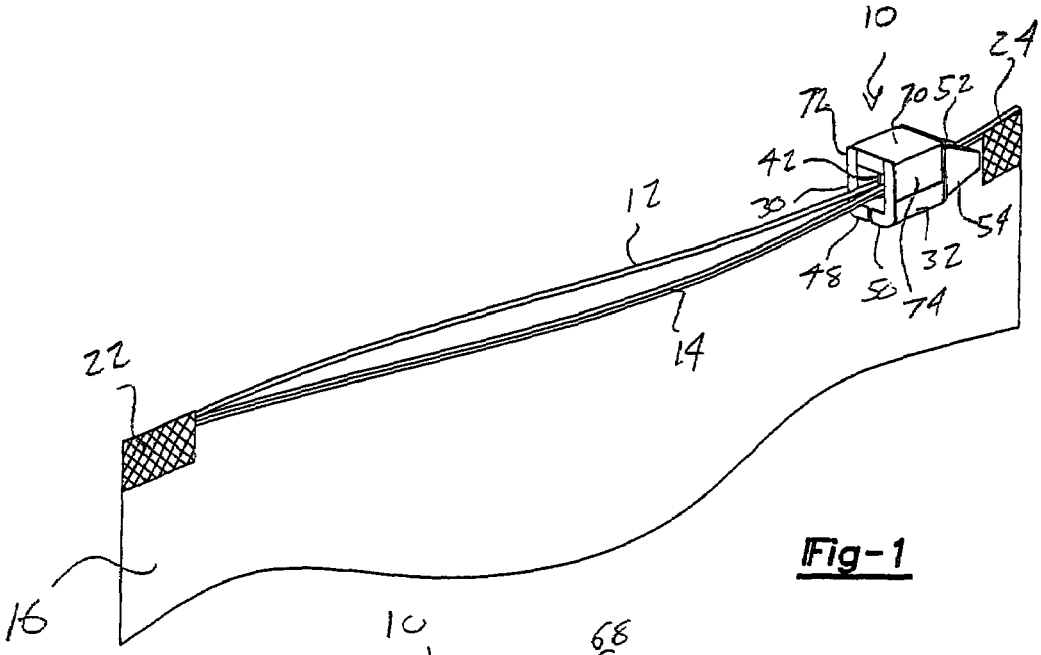
FIG. 1 is an environmental view of the two-piece slider assembled over first and second opposing and reclosable portions according to the present invention.
Figure 2:
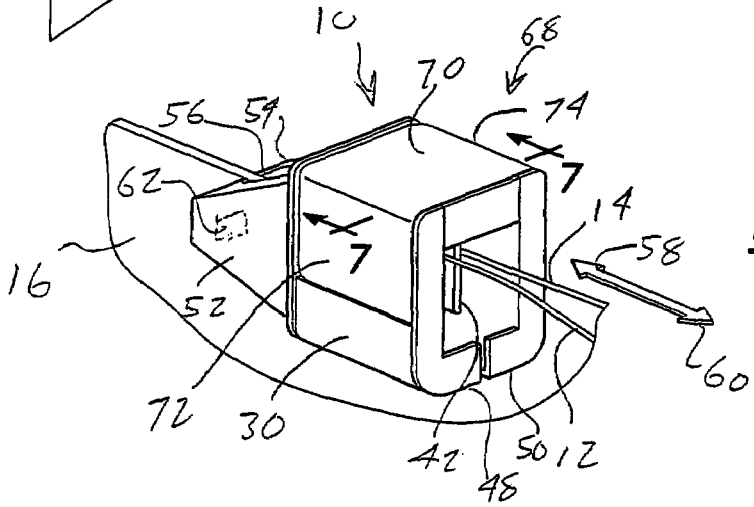
FIG. 2 is an enlarged and rotated perspective view of the assembleable slider in place over the opposingly extending and reclosable portions and such that traversing motion of the slider selectively unseals and reseals the plastic bag.
Figure 3:
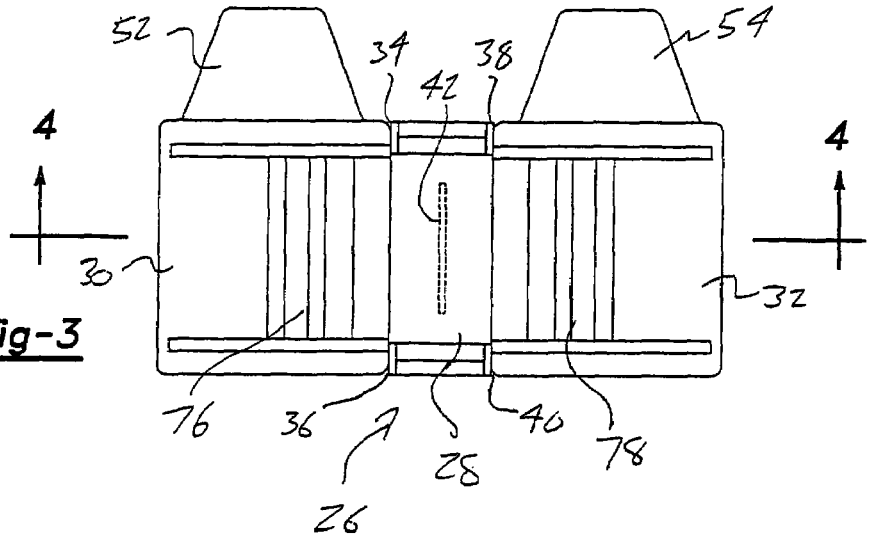
FIG. 3 is a plan view of a first main body of the assembleable slider and exhibiting the features of the central splitter and first and second hingedly attached and foldable wings according to the present invention.

A blade 42 extends downwardly from an associated bottom surface of the central portion 28 and such that, upon pre-positioning of the main body 26 over the bag 16, the blade 42 extends between the male 18 and female 20 profiles associated with the reclosable portions 12 and 14 and as is best illustrated in FIGS. 2, 6 and 7. At this point, an intermediate assembly step includes the downwardly folding of the wings 30 and 32, from the initial position illustrated in FIG. 4 and along the direction of referenced arrows 44 and 46.

Opposing and inwardly directed pincer portions are illustrated at 48 and 50, associated with bottom extending edges of the wings 30 and 32, and bias against opposed facing sides of the bag 16 upon downward folding of the pincer portions. First and second mating portions 52 and 54 integrally extend from an end of each of the foldable wings 30 and 32, and define therebetween a narrowed aperture 56 through which the biasingly mating male and female profiles 18 and 20 are compressed upon traversing motion of the slider in a selected direction 58 (FIG. 2) relative to an axial direction along the reclosable portions.

In contrast, traversing of the slider body in an opposite direction 60 (again FIG. 2) results in the unsealing of the mating portions 18 and 20 by the blade 42. It is also understood that the folding wings 30 and 32 define therebetween an extending channel along the interior axial length of the main body 26, communicating the blade with the narrowed aperture 56, and it is further envisioned that the geometry of the main body may be altered such that the narrowed aperture is moved to a front or leading edge of the mating portions 52 and 54, and such as which is further illustrated in phantom at 62 in FIG. 2. Referring again to FIG. 4, pairs of bead portions 64 and 66 may extend from opposing edges of the wings 30 and 32 and to better seal against the surfaces of the bag 16.

Referring again to the several views, a substantially "U" shaped cap (typically constructed from the same plastic material as the main body 26) is referenced generally at 68 and includes a central body portion 70 from which extend a first side 72 and a second side 74. The foldable wings 30 and 32 each further include an exteriorly configured surface proximate an upper end thereof and which is shown at 76 and 78. The first and second extending sides 72 and 74 associated with the assembleable cap in turn exhibit interiorly configured surfaces, see at 80 and 82, for matingly interengaging with the exteriorly configured surfaces associated with the wings 30 and 32 upon downward installation of the cap 68 in the direction of arrow 84 in FIGS. 4 and 5 and in order to securely engage the cap 68 over the folded main body 26, and the main body in turn over and between the reclosable portions 12 and 14 of the bag 16.

Having described my invention, other and additional preferred embodiments will become apparent to those skilled in the art to which it pertains and without deviating from the scope of the appended claims. In particular, it is also envisioned that a strap (not shown) can interconnect the cap 68 to the main body 26 and such that it facilitates quicker manual assembly of the slider assembly over the resealable bag portions.

I claim:

1. A slider for assembly over first and second extending and reclosable portions associated with a resealable bag, each of the reclosable portions including an opposing and biasingly mating profile, said slider comprising:

a main body exhibiting a central portion and first and second hingedly attached and foldable wings, said central portion exhibiting a splitter element, said foldable wings defining therebetween a resealing element;

a substantially "U" shaped and assembleable cap portion engageable upon said main body and upon said body being pre-positioned relative to the extending reclosable portions such that said splitter element separates a first location of the reclosable portions, said wings further folding downwardly against opposite sides of the bag such that said resealing element rejoins a second location of the reclosable portions; and said splitter element further comprising an extending blade separating the opposing and mating profiles associated with the reclosable portions and upon traversing motion of said slider in a first direction relative to the reclosable portions.

2. The slider as described in claim 1, said resealing element further comprising first and second mating portions extending from an end of each of said foldable wings and which define therebetween a narrowed aperture through which the biasingly mating profiles are compressed upon traversing motion of said slider in a second selected direction relative to the reclosable portions.

3. The slider as described in claim 2, said foldable wings defining therebetween an extending channel extending an axial length of said main body and in communication with said blade and said narrowed aperture.

4. The slider as described in claim 1, each of said foldable wings further comprising an inwardly directed and bag pincer portion extending along a bottom edge.

5. The slider as described in claim 1, said central portion exhibiting a substantially rectangular shaped body from which said splitter element extends.

6. The slider as described in claim 1, each of said foldable wings further comprising an exteriorly configured surface proximate an upper end thereof.

7. The slider as described in claim 1, first and second extending sides associated with said assembleable cap each further comprising an interiorly configured surface for matingly interengaging with said exteriorly configured surfaces associated with said wings.

8. A slider for assembly over first and second extending and reclosable portions associated with a resealable bag, each of the reclosable portions including an opposing and biasingly mating profile, said slider comprising:

a main body exhibiting a central portion and first and second hingedly attached and foldable wings, said central portion exhibiting a downwardly extending blade extending between opposing locations of the reclosable portions and separating the opposing and mating profiles associated with the reclosable portions upon traversing motion of said slider in a first direction relative to the reclosable portions;

said foldable wings defining therebetween a resealing element including first and second mating portions extending from an end of each of said foldable wings and which define therebetween a narrowed aperture through which the biasingly mating profiles are compressed upon traversing motion of said slider in a second selected direction relative to the reclosable portions; and a substantially "U" shaped and assembleable cap portion engageable upon said main body and upon said body being pre-positioned relative to the extending reclosable portions.

* * * * *